US011248456B2

(12) United States Patent
Bull et al.

(10) Patent No.: US 11,248,456 B2
(45) Date of Patent: Feb. 15, 2022

(54) SIMULTANEOUS MULTIPLE WELL STIMULATION

(71) Applicant: HALLIBURTON ENERGY SERVICES, INC., Houston, TX (US)

(72) Inventors: Brad Robert Bull, Duncan, OK (US); Tim H. Hunter, Duncan, OK (US); Kurt Rohrbough Harpold, Jr., Kingwood, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/839,448

(22) Filed: Apr. 3, 2020

(65) Prior Publication Data

US 2021/0310346 A1 Oct. 7, 2021

(51) Int. Cl.
*E21B 43/26* (2006.01)
*E21B 43/267* (2006.01)

(52) U.S. Cl.
CPC ..... *E21B 43/2607* (2020.05); *E21B 43/267* (2013.01)

(58) Field of Classification Search
CPC ..... E21B 43/2067; E21B 43/267; E21B 43/26
See application file for complete search history.

(56) References Cited

U.S. PATENT DOCUMENTS 5,899,272 A * 5/1999 Loree ..... C09K 8/80 166/280.2
6,644,844 B2 11/2003 Neal et al.
9,903,190 B2 2/2018 Conrad et al.
10,392,914 B2 8/2019 Kajaria
2007/0277982 A1* 12/2007 Shampine ..... E21B 43/16 166/308.1
2011/0030963 A1* 2/2011 Demong ..... E21B 43/26 166/313
2017/0198548 A1 7/2017 Dickinson
2018/0179848 A1 6/2018 Cherewyk
2018/0291718 A1 10/2018 Conrad et al.
2019/0136677 A1 5/2019 Shampine et al.

FOREIGN PATENT DOCUMENTS

WO WO-2016178956 A1 * 11/2016 ..... F04F 13/00

* cited by examiner

*Primary Examiner* — James G Sayre
(74) *Attorney, Agent, or Firm* — Polsinelli PC

(57) ABSTRACT

A plurality of clean fluid pumps fluidically coupled to a common line, the plurality of clean fluid pumps configured to pump a clean fluid. A plurality of individual lines extending from the common line to a plurality of wellbores, each wellbore of the plurality of wellbores having at least one individual line of the plurality of lines solely fluidically coupled thereto. A plurality of dirty fluid pumps, each wellbore of the plurality of wellbores having at least one of the dirty pumps solely fluidically coupled thereto, the fluidic coupling being downstream from the common line. A flow control device, such as a choke, installed in at least one of the individual lines, the installation being downstream from the common line and upstream from the point of the fluidic coupling of the at least one dirty fluid pump to the corresponding wellbore.

20 Claims, 4 Drawing Sheets

SIMULTANEOUS MULTIPLE WELL STIMULATION

FIELD

The present disclosure pertains to multiple well stimulation, and in particular, the present disclosure is directed to simultaneous multiple well stimulation using a plurality of clean and dirty pumps.

BACKGROUND

After drilling a wellbore, fracturing operations are carried out to stimulate hydrocarbon production from the wellbore. Such operations involve pumping a fracturing fluid at high pressures into the wellbore to induce fractures in the surrounding subterranean formation. The fracturing fluid may include proppants, which enter the fractures and "prop" the fractures open to enhance the flow of hydrocarbons in to the wellbore. Proppants are typically made up of sand or a similar small solid particulate. Inclusion of the proppant in the fracturing fluid can cause the fluid to take on an abrasive quality. Such abrasive fluid can tend to wear out equipment in the field such as pumps, tubulars and valves, and can require maintenance or replacement parts and decrease the efficiency of the wellsite.

In order to pump fracturing fluid, there may be the use of two streams, a clean stream as well as a dirty stream. The clean stream generally lacks solid material, such as the aforementioned proppants or other particulates, whereas the dirty stream includes such solid material. Additionally, there may be a different set of pumps for the clean stream and another set for the dirty stream. Furthermore, modern well sites may often have drilled multiple wellbores each may having different conditions or requirements for fracturing.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1A:
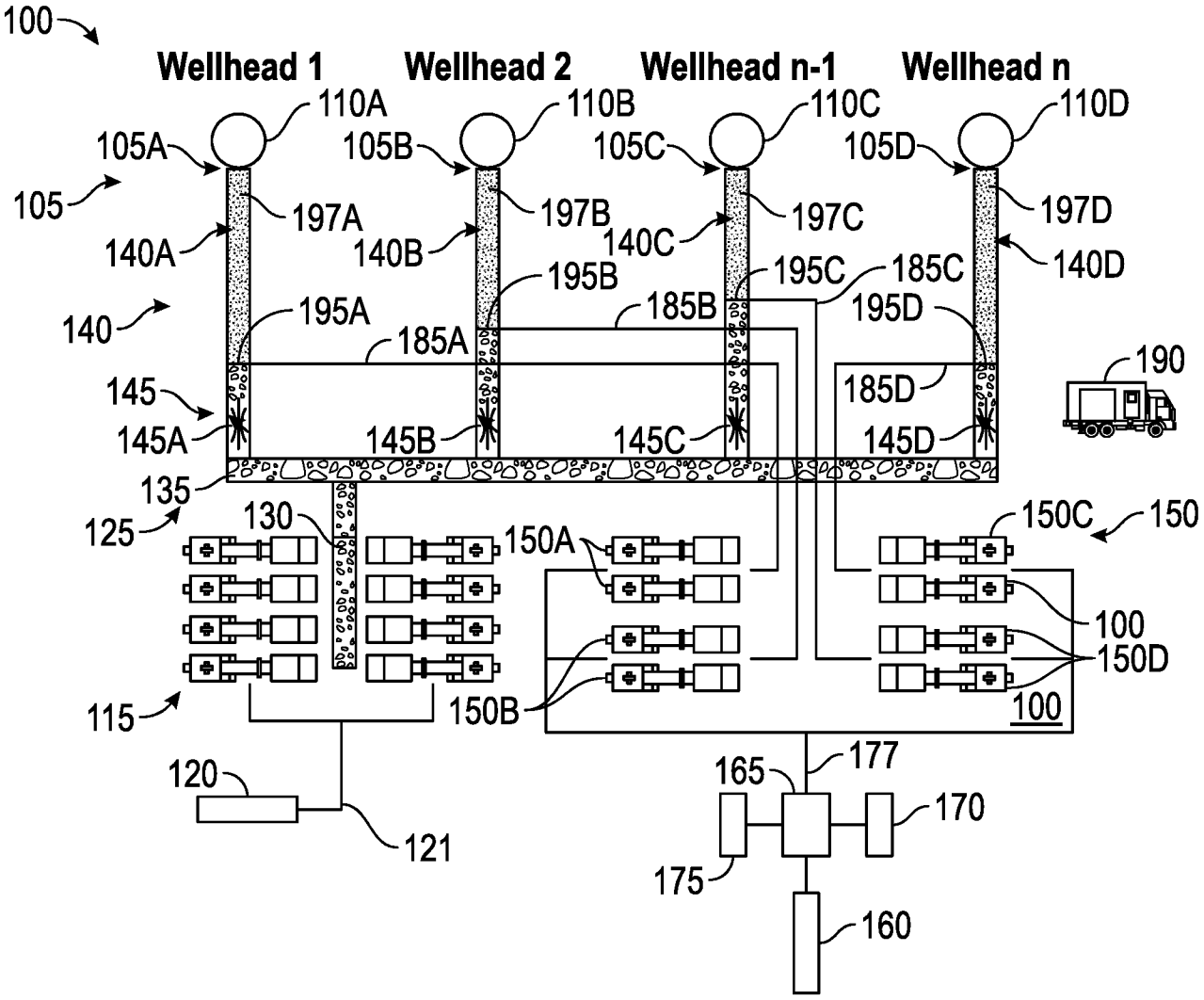
FIG. 1A is a schematic diagram of an exemplary wellsite environment for implementation of the systems and methods as described herein.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure. Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

Disclosed herein is a well site pump configuration for the simultaneous stimulation of a plurality wellbores using a plurality of clean pumps and a separate plurality of dirty pumps with at least one dirty pump solely dedicated to each wellbore. A variable choke is provided on at least one of the plurality of lines delivering clean fluid from the clean pumps upstream from the plurality of dirty pumps. The particular configuration disclosed herein of clean and dirty pumps and the placement of their fluidic coupling with the plurality wellbores may enhance control and efficiency, as well as decrease capital costs and maintenance.

The plurality of clean pumps are configured to pump a clean fluid which is free of solids, such as proppants. The plurality of clean pumps operate to pump clean fluid into a common line, which may be a flow control unit such as a manifold. From the common line, a plurality of individual lines extend such that each wellbore has at least one individual line solely fluidically coupled to it. Accordingly, each wellbore on the wellsite has at least one individual line fluidically coupled and solely dedicated to pumping clean fluid to it from the plurality of clean pumps. With such a configuration, where the clean fluid pressure and flow is shared amongst all wells, the capital costs and maintenance may be reduced. For instance, if a clean pump fails, the other plurality of pumps are still available for pumping. Additionally, the requisite footprint of the equipment at the wellsite may be reduced because all of the clean pumps may be grouped together, and thereby provides a cohesive area for servicing of pumps if required. Coupling the clean pumps together also reduces the amount of spare pumps needed on location to ensure service quality.

Distinct from the clean pumps are a plurality of dirty pumps. The plurality dirty pumps are configured to pump a dirty fluid, which contain solids, such as proppants, and wherein the fluid may be abrasive. Each wellbore has at least one of the dirty pumps solely fluidically coupled to it and dedicated to providing dirty fluid. Each wellbore may have one or more dedicated pumps to control or increase the flow rate and/or pressure.

Accordingly, each wellbore has a clean individual line from the common line, as well as at least one dedicated dirty pump. In this way, the clean pumps can all be grouped together to pump to the same common line, and only the dirty pumps are separately dedicated to each of the wellbores.

In order to control the flow rates of the clean fluid entering the wellbores, a flow control device, such as a variable choke can be installed or otherwise provided in at least one of the individual lines extending from the common line to the wellbores. Alternatively, a variable choke may be provided in a plurality or each of the individual lines extending from the common line to the wellbores. The variable choke may be adjusted to restrict or increase the flow rate and/or pressure of the flow of clean fluid being pumped from the common line to the wellbores. Other variable flow control devices include valves, variable orifices, inflatable bladders, packers, variable length reduced-bore piping restrictions, tortuous path devices.

Additionally, the dirty pumps are fluidically coupled downstream from variable chokes toward the wellbores or inside the wellbore. Accordingly, the clean and dirty fluids may be combined downstream from the variable choke but upstream from (prior to) entering the wellbore. The flow rate of the clean fluid may be controlled by the variable chokes. At the same time, the flow rates of the dirty fluid to the individual lines as well as the wellbores can be directly controlled by the dirty pumps. In this way, by controlling the clean pump flow rates, the variable chokes, and the dirty pump flow rate, the total flow rate and concentration of solids in the fluid entering the wellbore may be controlled.

FIG. 1 depicts a wellsite operating environment 100 according to the disclosure herein. The wellsite 100 may have a plurality of wellbores 105, and in this case, there is shown four wellbores 105A, 105B, 105C, and 105D. While four are shown, any number or any plurality of wellbores of two or more can be provided on the wellsite, such as wellbore 1, wellbore 2, wellbore n, and wellbore n+1, wherein n is 0 or more. Each of the plurality of wellbores 105A-105D may also have a wellhead 110A, 110B, 110C, and 110D respectively.

Also depicted in FIG. 1 is a plurality of clean pumps 115. Although eight clean pumps 115 are shown, any plurality of clean pumps may be used. For instance, the number of pumps may range from one to ten, two to eight, three to six or any number of pumps. The number of pumps may depend on the corresponding number of wellbores and the required pressures and flow rates. The clean pumps 115 may be high horsepower and high pressure pumps. Such pumps may be positive displacement pumps, or alternatively any other type of pump such as centrifugal pumps. Each of the plurality of clean pumps 115 may provide high horsepower, such as in the range from 400 to 10000 hydraulic horsepower (HHP), or from 800 to 2,500 HHP, or from 1,000 to 2,200 HHP. The pumps may provide high pressures of up to 20,000 psi, or in the range from 5,000 psi to 20,000 psi, alternatively from 10,000 psi to 15,000 psi, or a combination of such ranges. Additionally they may provide a flow rate of from 2.5 to 100 barrels per minute (bpm), or alternatively from 5 BPM to 15 BPM, or a combination thereof.

The number of pumps may depend on the hhp required for carrying out the fracturing operations of the plurality of wellbores, such as wellbores 105A-D. This may depend on the number of wellbores and/or the conditions of each wellbore, such as the pressures needed to fracture the formations within each wellbore, which may be the same or different from amongst the wellbores. For instance, if the required hhp for the fracturing operations requires 10,000 hhp, then the corresponding number of clean pumps are required, such as at least five pumps delivering 2,000 hhp. More pumps may be employed than the minimum required so as to assure sufficient horsepower and pressure, to reduce the load on the equipment and/or in case some pumps fail or require servicing.

The plurality of clean pumps 115 are configured to pump clean fluid. Clean fluid herein may be water based, and may include water, fresh water, seawater, saltwater, brine, produced water, water containing salts or other trace elements, deionized water, or other water. The clean fluid is characterized as having no solids, or essentially no solids, such solids being particulates, such as proppants, including sand or other hard components. Clean fluid having essentially no solids may be a fluid having very low concentrations of solids and is not abrasive, as some wellsites may be a complex environment, there may be small amounts of particulates which are found to be present in the clean fluid despite best efforts. The clean fluid can be stored or provided in tank 120 and pumped via a transfer line 121 which may employ a transfer pump (not shown), to the plurality of clean pumps 115. The clean fluid can be provided individually to each of the plurality of clean pumps 115 or may be provided in a transfer line 121.

The plurality of clean pumps 115 pump clean fluid into a common line 125 which may include an initial common line 130, which may be a fracturing manifold, and a main common line portion 135. From the main common line portion 135 there extends a plurality of individual lines 140A, 140B, 140C, and 140D which extend to corresponding wellbores 105A-D. The number of individual lines may correspond to the number of wellbores, such that each individual line extends to each of the wellbores of the plurality of wellbores on the wellsite. By this wellsite configuration where clean pumps 115 pump to a common line 125, followed by individual lines 140A-D to corresponding wellbores 105A-D, the injection of clean fluid may be carried out more efficiently. The clean pumps may be grouped together in the same area and all pumped with the same properties of flow rate, pressure, and HHP into the common line 125. By this similar grouping and treatment, efficiencies may be improved. Further, if any of the clean pumps fail or need servicing, pumping of the clean fluid need not stop, as the remaining pumps may still be employed.

In order to control and tailor the properties of the fluid to the wellbore a variable flow control device is provided on at least one of the individual lines leading to the wellbores and downstream from the common line. As illustrated in FIG. 1, variable chokes 145A, 145B, 145C, and 145D (plurality of variable chokes 145) are installed on each of the individual lines 140A-D downstream from the common line 125. The variable chokes 145A-D can be adjusted to partially or fully open or closed to restrict or expand flow through the individual lines 140A-D so as to obtain a desired predetermined flow rate. The variable chokes 145A-D are independently adjustable from one another so that the flow rate for each individual wellbore 105A-105D can be adjusted to desired predetermined flow rates.

Illustrated in FIG. 1 are a plurality of dirty pumps 150 fluidically coupled to the plurality of wellbores 105A-D that pump a dirty fluid to these wellbores. The dirty pumps 150 are shown as four pairs of pumps, each pair being solely fluidically coupled to a wellbore. In particular, each of the pairs of pumps 150A-D pump dirty fluid to a corresponding individual well 105A-D of the plurality of wellbores. While the dirty pumps 150 are shown as pairs, they may also be provided individually for each wellbore 105A-D, pairs as shown, or alternatively in groups of three, four, five or more dirty pumps. Accordingly, any number of sets of dirty pumps may be provided for pumping to the plurality of wellbores 105, fluidically coupled with a wellbore for pumping dirty fluid, and may be set independently of one another, where the number of sets may be equivalent to the number of wellbores, and each set may have one, two, three, four, five or more pumps, and may range from one to ten, two to eight, three to six or any number of pumps.

Each of the wellbores 105A-D may have at least one each of the plurality of dirty pumps 150 solely fluidically coupled thereto via dirty lines 185A, 185B, 185C, and 185D respectively. This way each of the wellbores 105A-D have at least one of the dirty pumps solely dedicated to pumping dirty fluid to it. While two are shown, any number of dirty pumps may be employed, from one to ten, two to eight, three to six or any number of dirty pumps. The dirty lines 185A-D fluidically coupled to the respective individual lines 140A-D at points 195A, 195B, 195C, and 195D. The points 195A-D are downstream from the variable chokes 145A-D, but up upstream of the wellbores 105A-D. As dirty fluid is provided into the individual lines 140A-D at points 195A-D, the dirty fluid is mixed with the clean fluid, forming a mixed fluid segments 197A, 197B, 197C, 197D in the individual lines 140A-D leading to wellbores 105A-D. By fluidically coupling the each of the plurality of dirty pumps 150 downstream from the plurality of variable chokes 145, the amount of dirty fluid delivered to the wellbores 105 can be controlled at each well.

Accordingly, each wellbore on the well site may have one or more dedicated dirty pumps, while being fed fluid from the same group of clean pumps via the common line and individual lines.

Figure 1B:
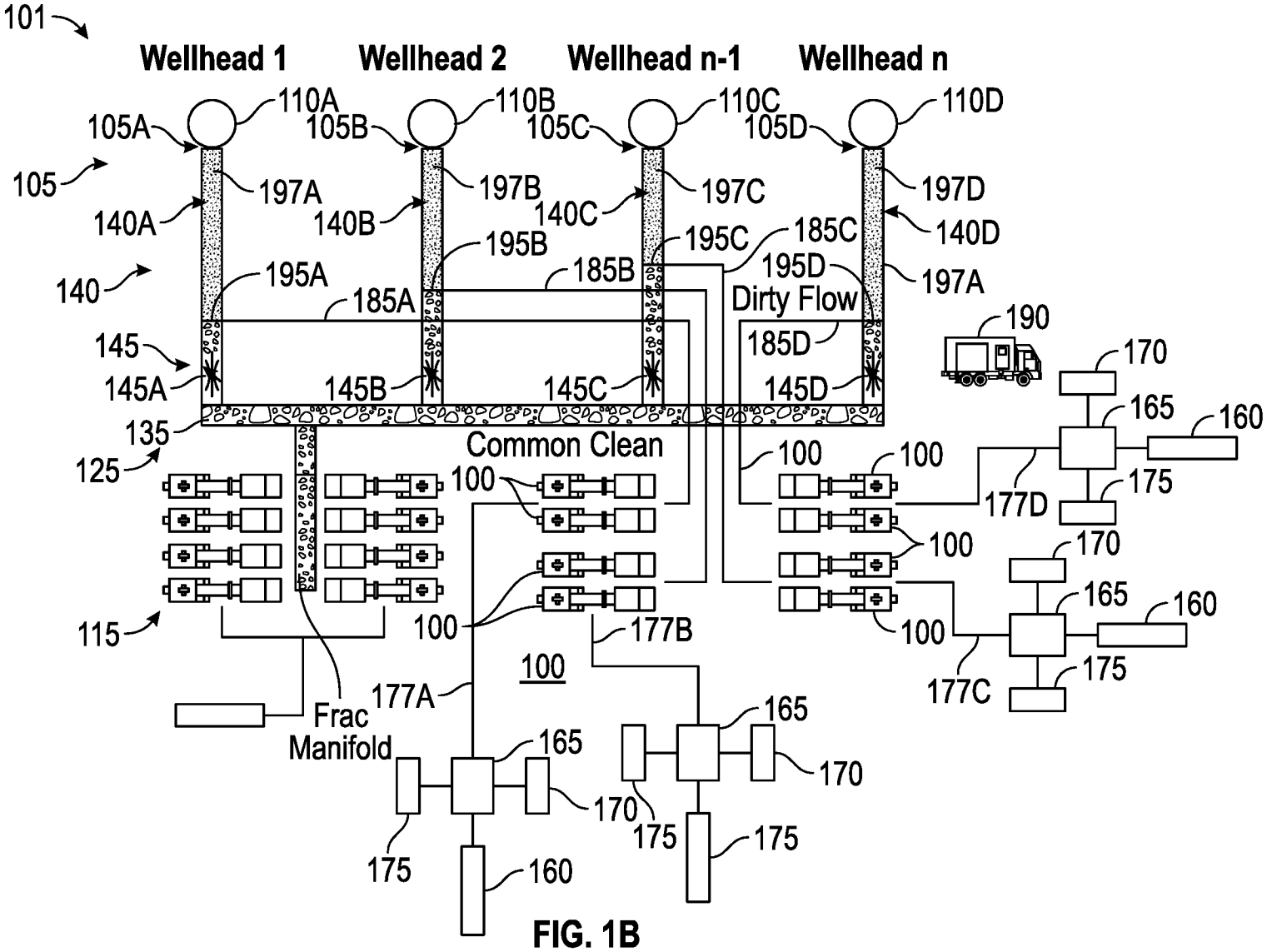
FIG. 1B is a schematic diagram of an exemplary wellsite environment for implementation of the systems and methods as described herein.

The dirty pumps may be provided with dirty fluid onsite as illustrated in FIG. 1. As shown, there may be a water tank 160, which feeds water to a blender 165. A proppant 175 may be provided to the blender 165 for mixing with the clean water, thereby converting the water to dirty water. While proppants are illustrated herein, any solids may be added to form the dirty fluid and which may cause the fluid to be abrasive. There may be additional chemicals 170 (such as gelling agents) which are provided to the blender 165. The dirty fluid from the blender 165 may be provided to the plurality of dirty pumps 150 via a single line 177 as shown in FIG. 1A. The dirty fluid, due to the inclusion of solids the dirty pumps may be subject to greater wear than the clean pumps, and so may require greater maintenance. As shown in the alternative, in the wellsite operating environment 101 of FIG. 1B, each of the pairs of dirty pumps may be fed with dirty fluid from their own dedicated water tank 160, blender 165, optional additional chemicals 170, for example via lines 177A-D.

The dirty pumps may be configured to provide the same HHP, pressure, and/or flow rate as the clean pumps 115. For instance the dirty pumps may provide horsepower in the range from 400 to 3000 hydraulic horsepower (HHP), or from 800 to 2,500 HHP, or from 1,000 to 2,200 HHP. The pumps may provide high pressures of up to 20,000 psi, or in the range from 5,000 psi to 20,000 psi, alternatively from 10,000 psi to 15,000 psi, or a combination of such ranges. Additionally they may provide a flow rate of from 2.5 to 20 barrels per minute (bpm), or alternatively from 5 bpm to 15 bpm, or a combination thereof.

The clean pumps 115 and the dirty pumps 150 may be operated to pump fluid simultaneously into the plurality of wellbores 105. The simultaneous well stimulation may increase efficiencies and production of hydrocarbons as multiple wellbores are stimulated at the same time.

Depicted in FIG. 1A is a control unit 190 which is on the surface of the wellsite, and may be installed on a truck or housing facility, or alternatively remote from the wellsite. The control unit 190 may be communicatively coupled either via wire or wireless to the components of the wellsite to control the relative flow rate and pressure of the clean and dirty fluids. The control unit 190 may be communicatively coupled with the variable chokes 145A-D to adjust the flow of the clean fluid to the plurality of wellbores. The control unit 190 may be further communicatively coupled with the plurality of dirty pumps 150 and may adjust the flow rates of the dirty fluid. Additionally, the control unit 190 may be communicatively coupled with the plurality of clean pumps to also adjust the flow rate of the clean pumps from the pumping source. Moreover, the sensors may be provided at the wellbores 105, the individual lines 140 and common line 125, to detect the flow rate, pressure, and temperature and/or composition of the fluids therein. Such sensors may be communicatively coupled with the control unit 190. Accordingly, the control unit 190 may control the simultaneous stimulation of the plurality of wellbores at the wellsite, and may independently adjust the flow rate of the clean fluid via the clean pumps and/or chokes and the flow rates of the dirty fluid via the dirty pumps to provide a predetermined composition, flow rate and/or pressure to the wellbores.

Figure 2:
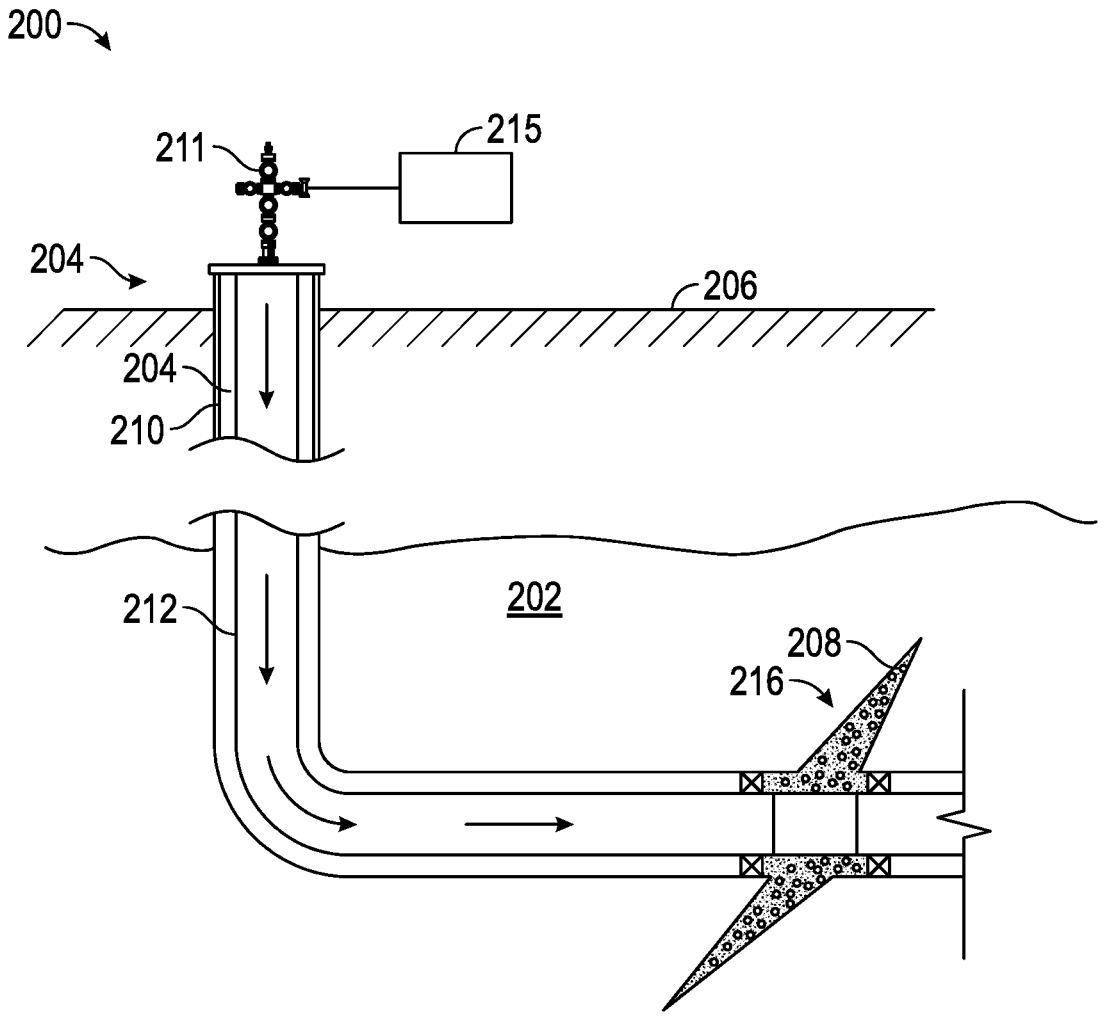
FIG. 2 is a schematic diagram of an exemplary wellbore for fracturing for the present disclosure.

FIG. 2 depicts a wellbore fracturing environment 200 having a wellbore 204 in which fracturing may be carried out. The wellbore 204 may illustrate fracturing which may be carried out in the one or more or each of the plurality of wellbores 105 of FIGS. 1A and 1B. A fracturing fluid of mixed clean and dirty fluid may be provided to the wellhead 211 from the fluid source 215 as described in FIGS. 1A and 1B. The wellbore 204 extends from the surface 206, and the fracturing fluid 208 is applied to a portion of the subterranean formation 202 surrounding the horizontal portion of the wellbore. Although shown as vertical deviating to horizontal, the wellbore 204 may include horizontal, vertical, slant, curved, and other types of wellbore geometries and orientations, and the fracturing treatment may be applied to a subterranean zone surrounding any portion of the wellbore. The wellbore 204 can include a casing 210 that is cemented or otherwise secured to the wellbore wall. The wellbore 204 can be uncased or include uncased sections. Perforations can be formed in the casing 210 to allow fracturing fluids and/or other materials to flow into the subterranean formation 202. In cased wells, perforations can be formed using shape charges, a perforating gun, hydro-jetting and/or other tools.

The wellbore 204 may include a work string 212 extending from the surface 206 into the wellbore 204. The work string 212 may include coiled tubing, jointed pipe, and/or other structures that allow fluid to flow into the wellbore 204. The work string 212 can include flow control devices, bypass valves, ports, and or other tools or well devices that control a flow of fluid from the interior of the work string 212 into the subterranean formation 202. The work string 212 and/or the wellbore 204 may include one or more sets of packers that seal the annulus between the work string 212 and wellbore 204 to define an interval of the wellbore 204 into which the fracturing fluid 208 will be pumped. When the fracturing fluid 208 is introduced into wellbore 204 at a sufficient hydraulic pressure, one or more fractures 216 may be created in the subterranean formation 202. The proppant particulates in the fracturing fluid 208 may enter the fractures 216 where they may remain after the fracturing fluid flows out of the wellbore. These proppant particulates may "prop" fractures 216 such that fluids may flow more freely through the fractures 216.

Exemplary proppants as solids in the dirty fluid as disclosed herein include particulates, sand, bauxite, ceramic materials, glass materials, polymer materials, polytetrafluoroethylene materials, nut shell pieces, cured resinous particulates having nut shell pieces, seed shell pieces, cured resinous particulates having seed shell pieces, fruit pit pieces, cured resinous particulates having fruit pit pieces, wood, composite particulates, and any combination thereof.

Figure 3:
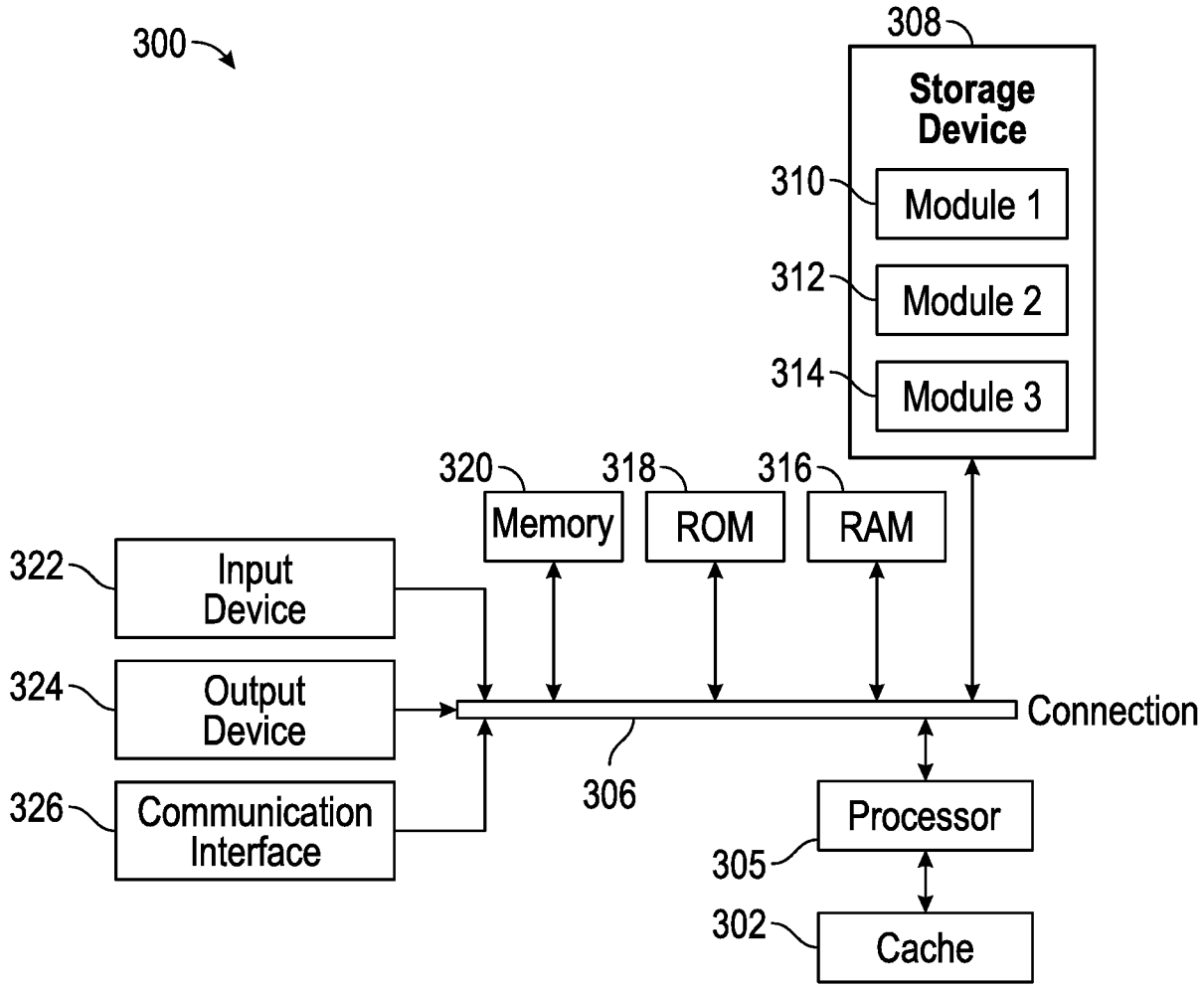
FIG. 3 is a schematic diagram of an example control unit for implementation with the present disclosure.

Specifically, FIG. 3 illustrates system architecture 300 which may be the control unit 190 of FIGS. 1A and 1B. As illustrated, the components of the system may be in electrical communication with each other using a bus 306. System architecture 300 can include a processing unit (CPU or processor) 305, as well as a cache 302, that are variously coupled to system bus 306. Bus 306 couples various system components including system memory 320, (e.g., read only memory (ROM) 318 and random access memory (RAM) 316), to processor 305. System architecture 300 can include a cache of high-speed memory connected directly with, in close proximity to, or integrated as part of the processor 305. System architecture 300 can copy data from the memory 320 and/or the storage device 308 to the cache 302 for quick access by the processor 305. In this way, the cache can provide a performance boost that avoids processor 305 delays while waiting for data. These and other modules can control or be configured to control the processor 305 to perform various actions. Other system memory 320 may be available for use as well. Memory 320 can include multiple different types of memory with different performance characteristics. Processor 305 can include any general-purpose processor and a hardware module or software module, such as module 1 (310), module 2 (312), and module 3 (314) stored in storage device 308, configured to control processor 305 as well as a special-purpose processor where software instructions are incorporated into the actual processor design. Processor 305 may essentially be a completely self-contained computing system, containing multiple cores or processors, a bus, memory controller, cache, etc. A multi-core processor may be symmetric or asymmetric.

To enable user interaction with the computing system architecture 300, input device 322 can represent any number of input mechanisms, such as a microphone for speech, a touch-sensitive screen for gesture or graphical input, keyboard, mouse, motion input, and so forth. An output device 324 can also be one or more of a number of output mechanisms. In some instances, multimodal systems can enable a user to provide multiple types of input to communicate with the computing system architecture 300. The communications interface 326 can generally govern and manage the user input and system output. There is no restriction on operating on any particular hardware arrangement and therefore the basic features here may easily be substituted for improved hardware or firmware arrangements as they are developed.

Storage device 308 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 316, read only memory (ROM) 318, and hybrids thereof.

Storage device 308 can include software modules 310, 312, 314 for controlling the processor 305. Other hardware or software modules are contemplated. The storage device 308 can be connected to the system bus 306. In one aspect, a hardware module that performs a particular function can include the software component stored in a computer-readable medium in connection with the necessary hardware components, such as the processor 305, bus 306, output device 324, and so forth, to carry out various functions of the disclosed technology.

Embodiments within the scope of the present disclosure may also include tangible and/or non-transitory computer-readable storage media or devices for carrying or having computer-executable instructions or data structures stored thereon. Such tangible computer-readable storage devices can be any available device that can be accessed by a general purpose or special purpose computer, including the functional design of any special purpose processor as described above. By way of example, and not limitation, such tangible computer-readable devices can include RAM, ROM, EEPROM, CD-ROM or other optical disk storage, magnetic disk storage or other magnetic storage devices, or any other device which can be used to carry or store desired program code in the form of computer-executable instructions, data structures, or processor chip design. When information or instructions are provided via a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable storage devices.

Computer-executable instructions include, for example, instructions and data which cause a general-purpose computer, special purpose computer, or special purpose processing device to perform a certain function or group of functions. Computer-executable instructions also include program modules that are executed by computers in standalone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

Numerous examples are provided herein to enhance understanding of the present disclosure. A specific set of statements are provided as follows.

Statement 1: A system comprising a plurality of clean pumps fluidically coupled to a common line, the plurality of clean pumps configured to pump a clean fluid; a plurality of individual lines extending from the common line to a plurality of wellbores, each wellbore of the plurality of wellbores having at least one individual line of the plurality of lines solely fluidically coupled thereto; a plurality of dirty pumps, each wellbore of the plurality of wellbores having at least one dirty pump of the plurality of dirty pumps solely fluidically coupled thereto, the fluidic coupling being downstream from the common line, and wherein the plurality of dirty pumps configured to pump a dirty fluid comprising solids; and a variable flow control device installed in at least one of the individual lines, the installation being downstream from the common line and upstream from the point of the fluidic coupling of the dirty fluid pump to the wellbore to which the individual line extends.

Statement 2: The system of Statement 1, further comprising a variable flow control device installed in each of the individual lines subsequent the common line and prior to the point of the fluidic coupling of the dirty fluid pumps to the wellbores to which the individual lines extend.

Statement 3: The system of Statement 1 or 2, further comprising a variable flow control device installed in a plurality of the individual lines subsequent the common line and prior to the point of the fluidic coupling of the dirty fluid pumps to the wellbores to which the individual lines extend.

Statement 4: The system of any one of the preceding Statements 1-3, the plurality of clean pumps and the plurality of dirty pumps simultaneously pumping to the plurality of wellbores, the clean pumps pumping clean fluid and the dirty pumps pumping dirty fluid.

Statement 5: The system of any one of the preceding Statements 1-4, a control unit communicatively coupled to the flow control device configured to variably adjust the flow control device to control the flow rate of the clean fluid.

Statement 6: The system of any one of the preceding Statements 1-5, wherein the solids are proppants.

Statement 7: The system of any one of the preceding Statements 1-6, wherein the clean line contains essentially no solids.

Statement 8: The system of any one of the preceding Statements 1-7, wherein the flow control device is a choke.

Statement 9: The system of any one of the preceding Statements 1-8, wherein a blender mixes a proppant to be pumped by any one of the plurality of dirty pumps.

Statement 10: A method comprising: pumping, via a plurality of clean pumps, a clean fluid to a common line, and from the common line through a plurality of individual lines to a plurality of wellbores, each wellbore of the plurality of wellbores having at least one individual line of the plurality of lines solely fluidically coupled thereto; pumping a dirty fluid from a plurality of pumps to the plurality of wellbores, each wellbore of the plurality of wellbores having at least one dirty pump of the plurality of dirty pumps solely fluidically coupled thereto, the fluidic coupling being downstream from the common line, and wherein the plurality of dirty pumps configured to pump a dirty fluid comprising solids; and variably adjusting the flow of clean fluid via a variable flow control device installed in at least one of the individual lines, the installation being downstream from the common line and upstream from the point of the fluidic coupling of the dirty fluid pump to the wellbore to which the individual line extends.

Statement 11: The method of Statement 10, further comprising a variable flow control device installed at each of the individual lines subsequent the common line and prior to the point of the fluidic coupling of the dirty pumps to the individual wellbores of the plurality of wellbores.

Statement 12: The method of Statement 10 or 11, the plurality of clean pumps and the plurality of dirty pumps simultaneously pumping to the plurality of wellbores, the clean fluid pumps pumping a clean fluid and the dirty pumps pumping a dirty fluid.

Statement 13: The method of any one of the preceding Statements 10-12, a control unit communicatively coupled to the flow control device configured to variably adjust the flow control device to control the flow rate of the clean fluid.

Statement 14: The method of any one of the preceding Statements 10-13, wherein the solids are a particulates.

Statement 15: The method of any one of the preceding Statements 10-14, wherein the solids are proppants.

Statement 16: The method of any one of the preceding Statements 10-15, wherein the clean line contains essentially no solids.

Statement 17: The method of any one of the preceding Statements 10-16, wherein the flow control device is a choke.

Statement 18: The method of any one of the preceding Statements 10-17, wherein a blender mixes a proppant to form the dirty fluid provided to at least one dirty pump.

Statement 19: A tangible, non-transitory, computer-readable media having instructions encoded thereon, the instructions, when executed by a processor, are operable to perform operations for, pumping, via a plurality of clean pumps, a clean fluid to a common line, and from the common line through a plurality of individual lines to a plurality of wellbores, each wellbore of the plurality of wellbores having at least one individual line of the plurality of lines solely fluidically coupled thereto; pumping a dirty fluid from a plurality of pumps to the plurality of wellbores, each wellbore of the plurality of wellbores having at least one dirty pump of the plurality of dirty pumps solely fluidically coupled thereto, the fluidic coupling being downstream from the common line, and wherein the plurality of dirty pumps configured to pump a dirty fluid comprising solids; and variably adjusting the flow of the clean fluid via a variable flow control device installed in at least one of the individual lines, the installation being downstream from the common line and upstream from the point of the fluidic coupling of the dirty fluid pump to the wellbore.

Statement 20: The computer-readable media of Statement 19, including further instructions for, when executed by the processor, variably adjusting a variable flow control device installed at each of the individual lines subsequent the common line and prior to the point of the fluidic coupling of the dirty pumps to the individual wellbores of the plurality of wellbores.

What is claimed is:

1. A system comprising:

a plurality of clean pumps fluidically coupled to a common line, the plurality of clean pumps configured to pump a clean fluid;

a plurality of individual lines extending from the common line to a plurality of wellbores, each wellbore of the plurality of wellbores having at least one individual line of the plurality of lines solely fluidically coupled thereto;

a plurality of dirty pumps, each wellbore of the plurality of wellbores having at least one dirty pump of the plurality of dirty pumps are solely fluidically coupled thereto, the fluidic coupling being downstream from the common line, and wherein the plurality of dirty pumps configured to pump a dirty fluid comprising solids; and a variable flow control device installed in at least one of the individual lines, the installation being downstream from the common line and upstream from the point of the fluidic coupling of the dirty fluid pump to the wellbore to which the individual line extends so that the variable flow control device only controls flow of the clean fluid.

2. The system of claim 1, further comprising a variable flow control device installed in each of the individual lines subsequent the common line and prior to the point of the fluidic coupling of the dirty fluid pumps to the wellbores to which the individual lines extend.

3. The system of claim 1, further comprising a variable flow control device installed in a plurality of the individual lines subsequent the common line and prior to the point of the fluidic coupling of the dirty fluid pumps to the wellbores to which the individual lines extend.

4. The system of claim 1, the plurality of clean pumps and the plurality of dirty pumps simultaneously pumping to the plurality of wellbores, the clean pumps pumping clean fluid and the dirty pumps pumping dirty fluid.

5. The system of claim 1, a control unit communicatively coupled to the flow control device configured to variably adjust the flow control device to control the flow rate of the clean fluid.

6. The system of claim 1, wherein the solids are proppants.

7. The system of claim 1, wherein the clean line contains essentially no solids.

8. The system of claim 1, wherein the flow control device is a choke.

9. The system of claim 1, wherein a blender mixes a proppant to be pumped by any one of the plurality of dirty pumps.

10. A method comprising:

pumping, via a plurality of clean pumps, a clean fluid to a common line, and from the common line through a plurality of individual lines to a plurality of well bores, each well bore of the plurality of wellbores having at least one individual line of the plurality of lines solely fluidically coupled thereto;

pumping a dirty fluid from a plurality of pumps to the plurality of wellbores, each wellbore of the plurality of wellbores having at least one dirty pump of the plurality of dirty pumps solely fluidically coupled thereto, the fluidic coupling being downstream from the common line, and wherein the plurality of dirty pumps are configured to pump a dirty fluid comprising solids; and variably adjusting the flow of the clean fluid via a variable flow control device installed in at least one of the individual lines, the installation being downstream from the common line and upstream from the point of the fluidic coupling of the dirty fluid pump to the wellbore to which the individual line extends so that the variable flow control device only controls the flow of the clean fluid.

11. The method of claim 10, further comprising a variable flow control device installed at each of the individual lines subsequent the common line and prior to the point of the fluidic coupling of the dirty pumps to the individual wellbores of the plurality of wellbores.

12. The method of claim 10, the plurality of clean pumps and the plurality of dirty pumps simultaneously pumping to the plurality of wellbores, the dean fluid pumps pumping a clean fluid and the dirty pumps pumping a dirty fluid.

13. The method of claim 10, wherein a control unit communicatively coupled to the flow control device is configured to variably adjust the flow control device to control the flow rate of the clean fluid.

14. The method of claim 10, wherein the solids are a particulates.

15. The method of claim 10, wherein the solids are proppants.

16. The method of claim 10, wherein the clean line contains essentially no solids.

17. The method of claim 10, wherein the flow control device is a choke.

18. The method of claim 10, wherein a blender mixes a proppant to form the dirty fluid provided to at least one dirty pump.

19. A tangible, non-transitory, computer-readable media having instructions encoded thereon, the instructions, when executed by a processor, are operable to perform operations for:

pumping, via a plurality of clean pumps, a clean fluid to a common line, and from the common line through a plurality of individual lines to a plurality of wellbores, each wellbore of the plurality of wellbores having at least one individual line of the plurality of lines solely fluidically coupled thereto;

pumping a dirty fluid from a plurality of pumps to the plurality of wellbores, each wellbore of the plurality of wellbores having at least one dirty pump of the plurality of dirty pumps solely fluidically coupled thereto, the fluidic coupling being downstream from the common line, and wherein the plurality of dirty pumps are configured to pump a dirty fluid comprising solids; and variably adjusting the flow of the clean fluid via a variable flow control device installed in at least one of the individual lines, the installation being downstream from the common line and upstream from the point of the fluidic coupling of the dirty fluid pump to the wellbore so that the variable flow control device only controls flow of the clean fluid.

20. The computer-readable media of claim 19, including further instructions for, when executed by the processor, variably adjusting a variable flow control device installed at each of the individual lines subsequent the common line and prior to the point of the fluidic coupling of the dirty pumps to the individual wellbores of the plurality of wellbores.

* * * * *